United States Patent [19]

Hudson et al.

[11] Patent Number: 4,461,136

[45] Date of Patent: Jul. 24, 1984

[54] METHOD AND APPARATUS FOR ENVELOPING A PLURALITY OF ITEMS IN A STRETCHABLE FILM

[75] Inventors: Doyle R. Hudson; Jimmie O. Dulaney, both of West Monroe, La.

[73] Assignee: Quachita Machine Works, Inc., West Monroe, La.

[21] Appl. No.: 335,734

[22] Filed: Dec. 30, 1981

[51] Int. Cl.[3] ..... B65B 11/04; B65B 13/04

[52] U.S. Cl. ..... 53/399; 53/465; 53/556; 53/587; 53/211

[58] Field of Search ..... 53/465, 587, 588, 556, 53/211, 399, 441

[56] References Cited

U.S. PATENT DOCUMENTS

| | | | |
|---|---|---|---|
| 965,317 | 7/1910 | Nyberg | 53/211 |
| 1,123,606 | 1/1915 | Smith | 53/587 |
| 1,362,382 | 12/1920 | Angier | 53/587 |
| 2,568,260 | 9/1951 | Spagnoli | 53/587 X |
| 2,612,737 | 10/1952 | Thielens | 53/587 X |
| 2,880,560 | 4/1959 | Gibson | 53/587 X |
| 3,099,117 | 7/1963 | Christiansen | 53/587 X |
| 3,149,446 | 9/1964 | Hood | 53/211 X |
| 3,605,375 | 9/1971 | Marshall | 53/587 X |
| 3,994,118 | 11/1976 | Felix | 53/587 X |
| 4,283,903 | 8/1981 | Mayhall | 53/587 |

FOREIGN PATENT DOCUMENTS

| | | | |
|---|---|---|---|
| 559480 | 7/1958 | Canada | 53/587 |
| 19013 | 7/1956 | Fed. Rep. of Germany | 53/587 |

*Primary Examiner*—John Sipos

*Attorney, Agent, or Firm*—Rodgers & Rodgers

[57] ABSTRACT

For enveloping a composite group of items in a stretchable film, a pair of initially spaced wrapping cage assemblies are moved inwardly toward each other so as to form a wrapping cage for supporting the composite group of items to be wrapped and for capturing a part of an elongated stretchable film between parts of the wrapping cage and of the composite group of items, rotating the wrapping cage assemblies so as to cause the stretchable film to envelop the composite group of items, withdrawing the wrapping cage assemblies outwardly so as to disengage the film and the composite group of items about which the stretchable film is wrapped and finally severing the stretchable film.

23 Claims, 5 Drawing Figures

METHOD AND APPARATUS FOR ENVELOPING A PLURALITY OF ITEMS IN A STRETCHABLE FILM

TECHNICAL FIELD

This invention relates to the packaging of a plurality of items such as paper bags of charcoal into a composite group of items by means which wraps a stretchable film about the group of items and automatically disconnects the wrapped film from the packaged group.

BACKGROUND ART

U.S. Pat. No. 3,867,806 issued Feb. 25, 1975 and titled "Process of Making a Stretched-Wrapped Package" discloses an arrangement wherein a group of items to be enveloped by a stretchable film is mounted on a platform and rotated about a vertical axis so as to apply a stretchable film rotatable about a vertical axis to envelop the group of items. In this arrangement, the leading end of the stretch film is attached to the group of items to be packaged by hand and after the packaging operation is completed, the trailing end of the film strip is welded with a hot iron and severed using manual techniques. Tension of the stretch film is applied by a spring biased lever system. One objectionable feature of the arrangement of U.S. Pat. No. 3,867,806 resides in the fact that hand operations are required to secure the leading end of the film and to secure and sever the trailing end of the film as well as to cut off the trailing end of the film. Of course these manual operations constitute a significant item of cost in this type of operation.

U.S. Pat. No. 4,050,220 issued Sept. 27, 1977 and titled "Spiral Bundler" discloses an arrangement wherein a series of package groups are mounted end to end on guide rails and moved therealong while a stretch film is wound spirally about the groups of items. After the spiral is applied to a series of package groups, the spiral film is severed so as to separate each package group from the adjacent package group. The friction between the spirally wound stretchable film and the guides which support the moving packages constitute a significant impediment to the efficient and smooth operation of this packaging operation.

U.S. Pat. No. 4,050,221 issued Sept. 27, 1977 and titled "Stretch-Wrapped Package Process and Apparatus" discloses an arrangement similar to the above mentioned U.S. Pat. No. 3,867,806. In addition U.S. Pat. No. 4,050,221 discloses a brake device which is turned on and off during the packaging operation so as to control the tension of the wrap as the packaging operation progresses.

U.S. Pat. No. 4,077,179 issued Mar. 7, 1978 and titled "Automatic Wrapping Apparatus" discloses an arrangement in which items to be packaged are held in place by a clamp assembly and the stretchable film is wrapped about the group of items and the clamp assembly. Of course this apparatus and procedure are objectionable because of the difficulties encountered in removing the clamp assembly from the completed package.

DISCLOSURE OF THE INVENTION

According to this invention in one form, a group of items is enveloped within a stretchable film by utilizing a pair of wrapping cage assemblies which are initially spaced apart then moved inwardly toward each other so as to form a wrapping cage for supporting the group of items to be packaged, the items being appropriately gripped in the wrapping cage which is rotated so as to cause a stretchable film to envelop the wrapping cage assemblies and the group of items, the leading edge of the stretchable film being captured between parts of the wrapping cage assemblies and the group of items to be packaged and the wrapping cage assemblies being moved outwardly substantially simultaneously and in opposite directions so as easily to disengage the film and the group of packages which are enveloped by the stretched film from the cage.

BEST MODE OF CARRYING OUT THE INVENTION

Figures 1, 1A:
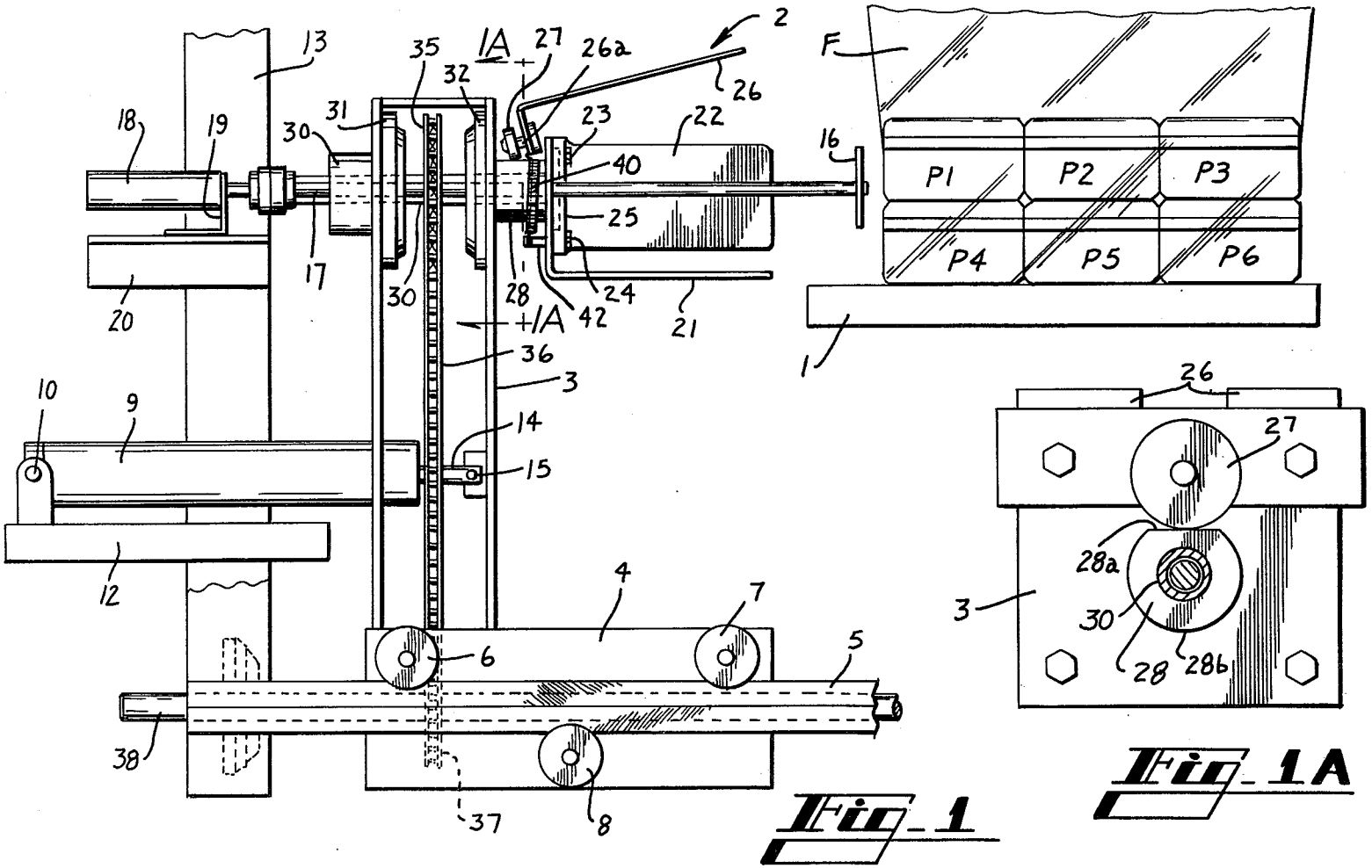
FIG. 1 is a side view of one portion of an apparatus formed according to this invention.
FIG. 1A is an enlarged cross sectional view taken along the line designated 1A—1A in FIG. 1.

In FIG. 1 a plurality of packages P1–P6 are stacked on a table not shown and which is not a part of the invention. These packages could be paper bags containing dog food, charcoal and the like and as shown in FIG. 1 have previously been manipulated and compressed to a desired size and configuration for suitable handling by the mechanism formed according to this invention.

Figure 2:
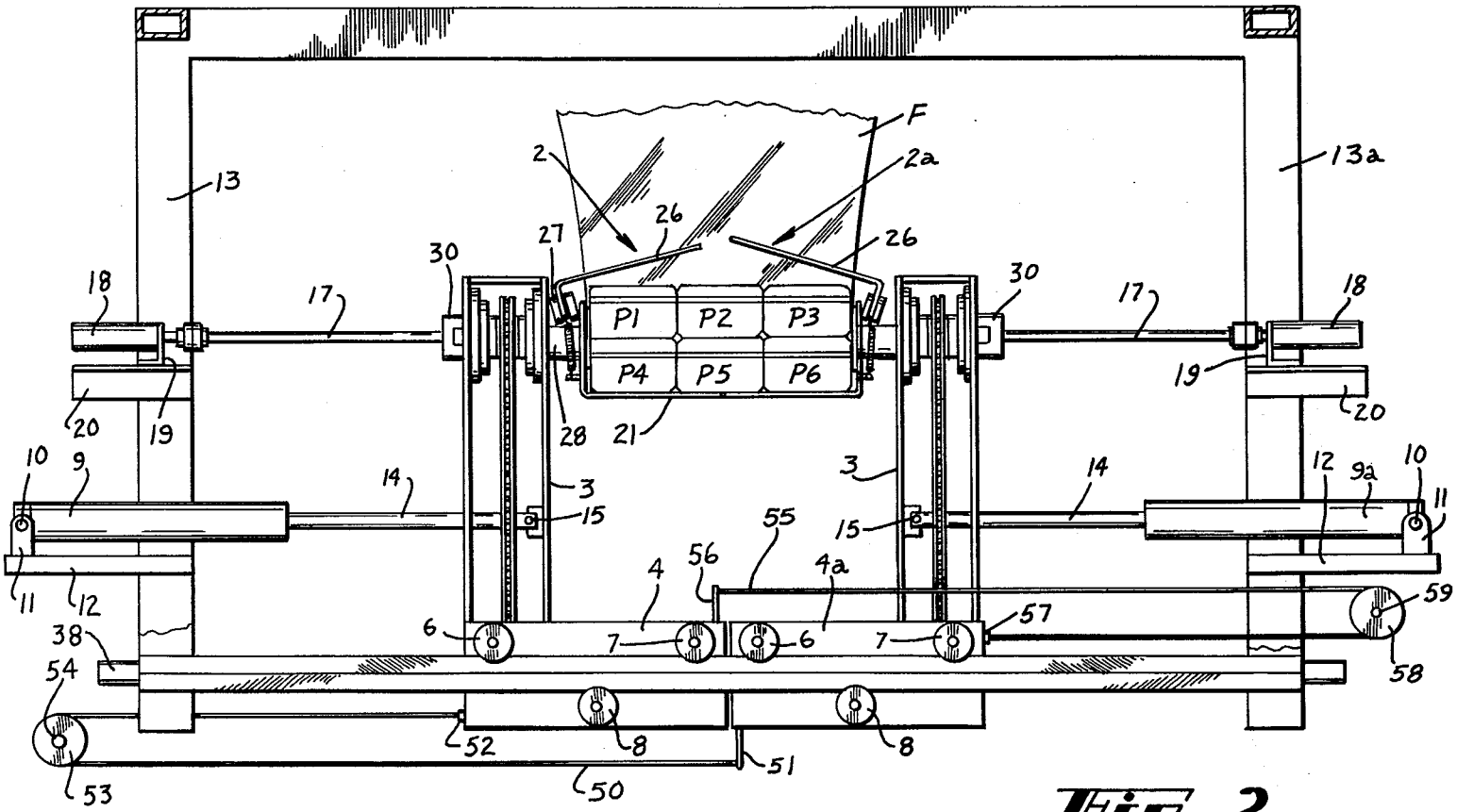
FIG. 2 is a view similar to FIG. 1 but which shows both sides of a mechanism formed according to the invention with the parts occupying their cage forming positions.
Figure 3:
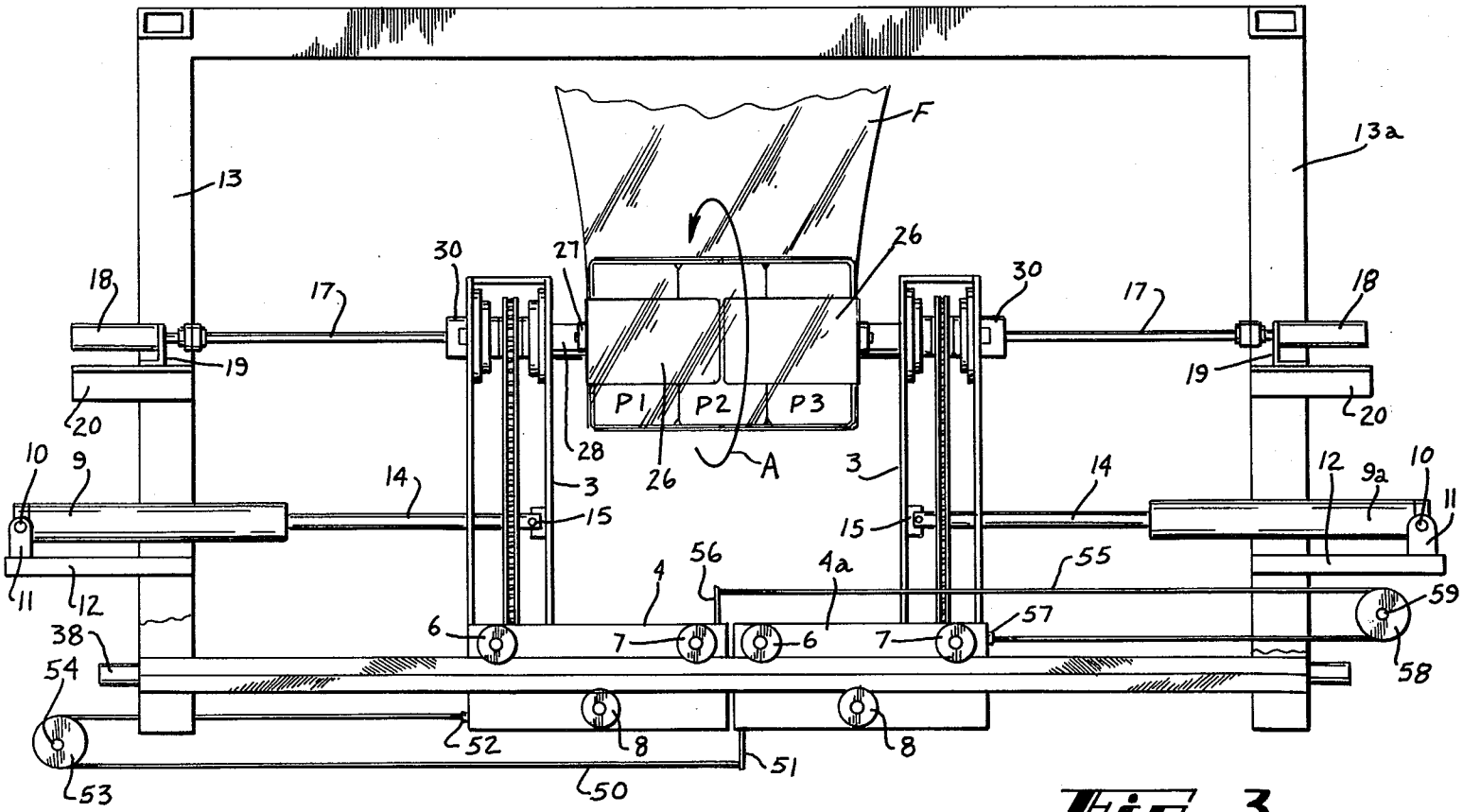
FIG. 3 is a view similar to FIG. 2 but which shows the apparatus after partial completion of a packaging operation.
Figure 4:
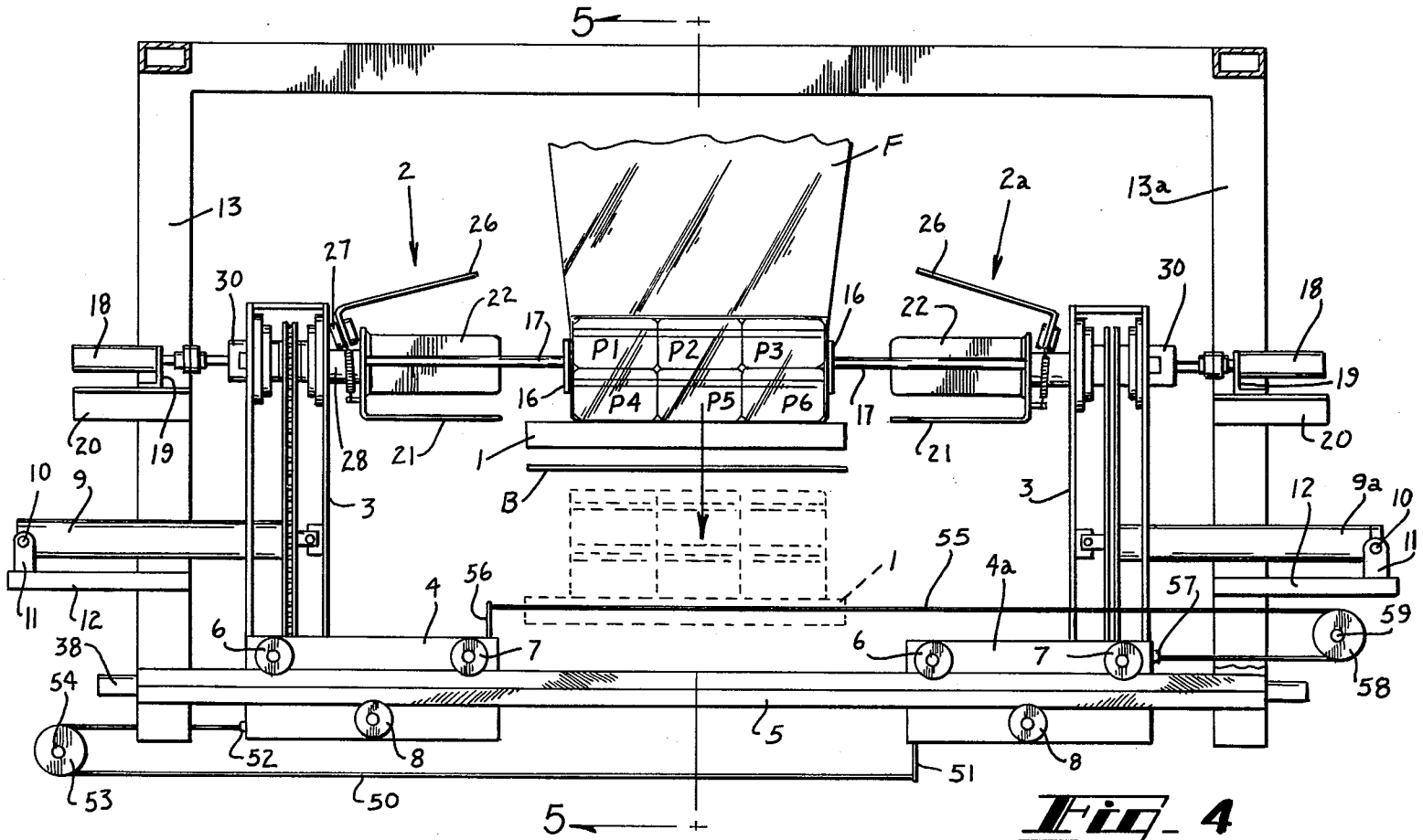
FIG. 4 is a view similar to FIGS. 2 and 3 and indicates the condition of the apparatus upon completion of a particular packaging operation where the completed package is shown in dotted lines.
Figure 5:
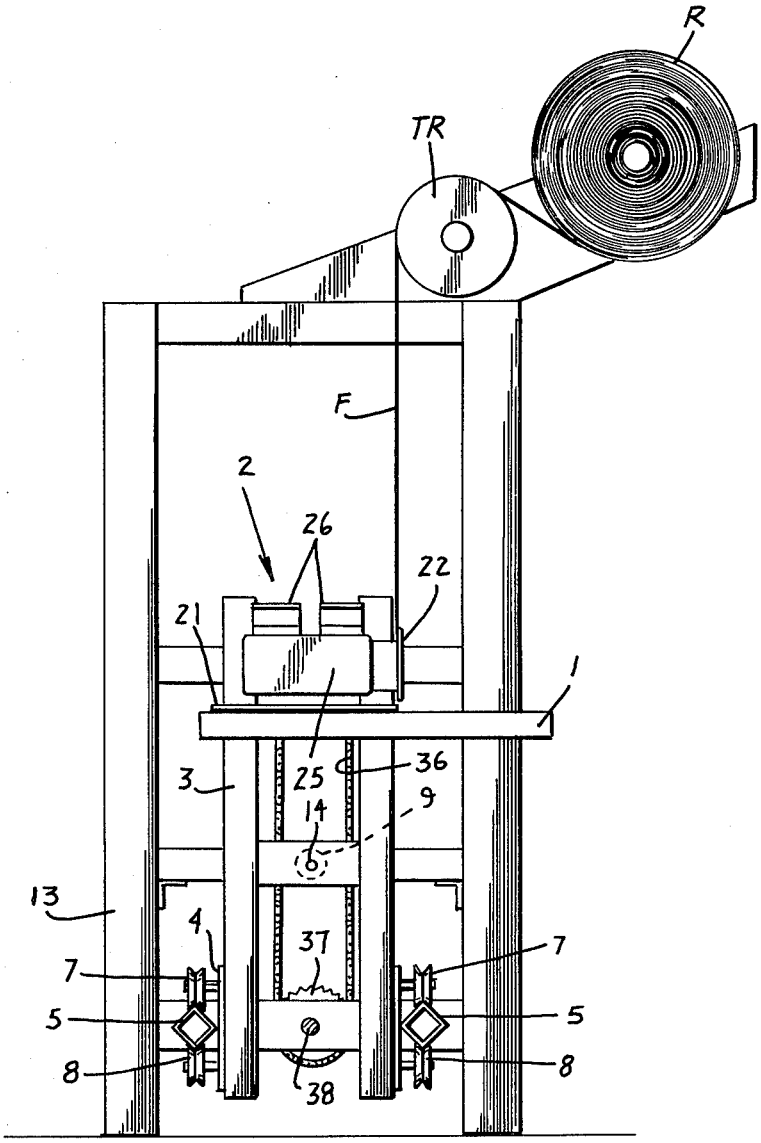
FIG. 5 is a cross sectional view taken on the line designated 5—5 in FIG. 4.

A wrapping cage assembly generally designated by the numeral 2 is mounted on a support carriage 3 securely mounted atop a dolly 4 which is movable from left to right as viewed in FIGS. 1, 2, 3, and 4 along a pair of laterally spaced tracks 5 which engage rollers 6 and 7 rotatably mounted on dolly 4 and rollers 8 which ride underneath rails 5 and which hold the dolly 4 in position relative to rails 5. Thus left to right movement of dolly 4 causes the wrapping cage assembly 2 to move from the position shown in FIG. 1 to a position to receive the packages P1–P6 as shown in FIGS. 2, 3 and 4.

A wrapping cage assembly **2*a* is identical in function and in structure to wrapping cage assembly 2. Parts of assembly 2*a* are designated by the same numerals as are used in connection with assembly 2** with the suffix "a" added to certain numerals.

The packages P1–P6 are pushed by means not shown into the wrapping cage when the wrapping cage assemblies are in the inboard position. The package groups are pushed from a table not shown which is disposed in front of the wrapping cage by pusher means not shown.

Left to right movement and vice versa is imparted to wrapping cage assembly 2, carriage 3, and dolly 4, by piston cylinder structure 9 which is mounted at one end on pin 10 supported by bracket 11 which in turn is mounted on platform 12 secured to upright structural element 13. Piston rod 14 is connected by pin 15 to carriage 3. Piston cylinder 9 and associated elements are effective to move the structure 2, 3 and 4 to and fro from the position shown in FIG. 1 toward the right and back again.

For the purpose of gripping the package group P1–P6, a pressure plate 16 is mounted at the right hand end of piston rod 17 which is activated by a piston and cylinder arrangement indicated by the numeral 18 secured by bracket 19 to support arm 20 which in turn is secured to upright structural support 13. Operation of the piston cylinder arrangement 18 imparts movement from left to right and vice versa to the pressure plate 16 thereby to grip and disengage the package group P1–P6.

Wrapping cage assembly 2 comprises a pair of platens 21 and 22 which are securely mounted by suitable bolts such as 23 and 24 to support structure 25. When the wrapping cage assembly 2 is moved from the position shown in FIG. 1 to that shown in FIG. 2 to form a wrapping cage with assembly 2*a* and after the packages P1–P6 are moved into the wrapping cage, platen 21 is disposed underneath the package group P1–P6 and platen 22 is disposed behind the package group P1–P6 as viewed in FIGS. 1, 2, and 4 and pressure plate 16 is alongside the package group.

A pivotally mounted platen 26 is arranged for initial disposition above the package group P1–P6 as indicated in FIG. 2. Platen 26 is mounted as pivot 26*a* to support structure 25 and is provided with a cam roller 27 which cooperates with a fixed cam structure 28 fixedly mounted to carriage 3.

As is apparent from FIG. 1A, the cam roller 27 cooperates with a flat chordal portion 28*a* of fixed cam 28 and by so doing allows the pivotally mounted platen 26 to occupy a position such as that shown for example in FIGS. 1 and 2. In this position, the pivotally mounted platen 26 overlies a portion of the package group P1–P6 when the wrapping cage assembly 2 is moved into the position represented in FIG. 2 after the package group has been inserted into the wrapping cage. Elevating platen 26 facilitates entry of the package group into the wrapping cage.

In order to initiate an initial packaging operation, film F is supplied from roll R and tensioning roll TR and the leading end of film F is inserted down into the wrapping cage assembly and in front of the back platen 22. When the package group P1–P6 is moved forwardly into the position shown in FIG. 2 the leading end of the film F is captured between fixed platen 22 and the package group P1–P6.

In order to envelop the package group with the film and also to cause the pivotally mounted platen 26 to move in a clockwise direction about pivot 26*a* and in accordance with a feature of this invention, the wrapping cage assembly is rotated in a direction indicated by the arrow A in FIG. 3. This rotation causes the roller 27 to ride off of the chordal portion 28*a* of fixed cam 28 and on to the circular portion 28*b* of the fixed cam 28 and thus imparts a clockwise rotation to the pivotally mounted platen 26 about its pivot 26*a*. Upon completion of this operation the package group P1–P6 is securely gripped by the wrapping cage assembly 2 and by its fellow 2*a* on the opposite side of the machine.

For the purpose of rotating wrapping cage assembly 2 about a horizontal axis, a hollow shaft 30 is mounted in suitable bearings 31 and 32 supported by carriage 3 and the right hand end of hollow shaft 30 is rigidly secured to support structure 25 so that rotation of hollow shaft 30 imparts rotation to wrapping cage assembly 2 and to the packages captured therein.

Shaft 30 is formed of a hollow structure so as to provide space for receiving the coaxial shaft 17 which as previously explained controls the left to right movement of pressure plate 16 whereby the packages P1–P6 are gripped.

Rotary movement is imparted to shaft 30 and to the sprocket 35 rigidly mounted thereto by means of a chain 36 driven by a sprocket 37 mounted on a shaft 38 disposed between the two laterally spaced rails 5 and rotated by conventional means not shown. Shaft 38 is a splined shaft of known construction which accommodates sliding movement from right to left and vice versa of the carriage 3 and of the dolly 4 without interfering with the driving relationship between splined shaft 38 and sprocket 37.

Rotary movement thus is imparted to wrapping cage assembly 2 by splined shaft 38, sprocket 37, chain 36, sprocket 35 and hollow shaft 30 which is secured to support structure 25. Thus the entire wrapping cage assembly including the platens 21, 22 and 26 as well as the package group P1–P6 disposed within the wrapping cage are rotated as indicated by the arrow A in FIG. 3. Such rotation of this structure causes the roller 27 ultimately to complete its travel about the circular portion 28*b* of cam 28 and to arrive once again at the chordal portion 28*a* of cam 28. When this condition occurs biasing spring 40 connected at 41 to pivotally mounted platen 26 at one end and to pedestal 42 on support 25 at the other end, imparts a force which tends to move the platen 26 into the position shown in FIG. 1. Such movement of pivotally mounted platen 26 is not possible after the package group P1–P6 has become enveloped by at least one wrap of film F because the film simply holds the platen 26 in its horizontal position against the action of biasing spring 40. Platen 26 is thus not free to return to the position shown in FIG. 1 until after the completion of a packaging operation and the withdrawal of wrapping cage assembly 2 from the position shown in FIG. 2 to that shown in FIG. 1 at which position the biasing spring 40 is effective to swing the platen 26 to the position shown in FIG. 1 so as to facilitate subsequent insertion of a succeeding package group into the wrapping cage.

Once the wrapping cage assembly 2 is moved from the position represented in FIG. 2 to that represented in FIGS. 1 and 4, gripping pressure of pressure plate 16 is released by appropriate action of piston cylinder mechanism 18 causing outward movement of plate 16 since the pressure plates are no longer needed to hold the package stationary during outward movement of the assemblies 2 and 2*a*.

It should be pointed out that the piston which forms a part of the cylinder piston 18 is rotatable within cylinder 18 because the pressure plate 16 must necessarily rotate during a rotating operation which causes the film F to envelop the package group P1–P6 and the wrapping cage 2, 2*a*.

Ordinarily the film F is wrapped twice around a package group P1–P6 and may simply be of one mil thickness. Such thickness when wrapped twice constitutes an envelopment of adequate strength for maintaining the integrity of the package.

Wrapping cage assembly 2 has been described above. Since wrapping cage assembly 2*a* is identical in structure and function to wrapping cage assembly 2, it is obvious that wrapping cage assembly 2a simply moves inwardly from the right as viewed in the drawings to provide the support for the right hand portion of the package group P1–P6 when inserted.

As is obvious, the piston cylinder mechanisms 9 and 9a constitute means for moving the wrapping cage assemblies 2 and 2a inwardly toward each other and outwardly away from each other.

In order properly to correlate the movement of these wrapping cage assemblies 2 and 2a, correlating means is provided for insuring uniform operation of the wrapping cage assemblies. Such correlating means comprises a flexible cable 50 secured at one end to pedestal 51 secured to dolly 4a and at the other end to pedestal 52 secured to dolly 4. Cable 50 is trained about a pulley 53 rotatable about a fixed shaft 54 supported by the frame 13. Similarly cable 55 is secured at one end to pedestal 56 which is mounted on dolly 4 and at its opposite end to bracket 57 securely affixed to dolly 4a. Cable 55 is trained about pulley 58 rotatable about a shaft 59 fixedly supported on upright frame structure 13a. Thus movement inwardly of wrapping cage assembly 2 and 2a is uniform and controlled throughout the entire in and out travel of these two assemblies.

Once a package group is enveloped by two or more revolutions of the film F, the table 1 rises to receive the package group and cage parts 2 and 2a move outward and pressure plates 16 are released. The package is deemed to be complete and is then lowered from the position represented, for example, in FIG. 4 in solid lines to the position indicated in dotted lines in FIG. 4. This action is accomplished by simply lowering the support table 1 from its solid line position to its dotted line position shown in FIG. 4. This action is automatically effected by mechanisms well known in the art.

During downward movement of the package group P1–P6 to the dotted line position, the film F remains attached to the package group P1–P6. Advantage is taken of this fact by moving the assemblies 2 and 2a inwardly so that the film lies along the inside surface of platen 22 and by simply inserting a succeeding composite package group such as P1–P6 from the fixed table not shown into the wrapping cage to the position such as is shown in FIG. 2. Thus the film F is automatically trapped or captured between the inside surface of back fixed platen 22 and a succeeding group of packages P1–P6. With the film thus captured, the apparatus is in condition to initiate a rotating operation.

In order to detach a completed package such as is shown in dotted lines in FIG. 4, from the film F, a fixed blade B is disposed to be engaged automatically by the film F as the package which is disposed at the position indicated by dotted lines in FIG. 4 is moved out of the machine on suitable conveyor means of conventional construction.

While this invention is not limited to any particular stretch film, it has been found that a stretch film marketed by Mobil Oil Corporation under the trademark "Mobil-X" is quite satisfactory.

Thus by the invention, automatic means are provided for securing the leading end of a film F in proper position for subsequent envelopment of the film about a package group. Furthermore upon completion of a packaging operation, the film is automatically severed at its trailing end for a particular package simply by movement of the outfeed conveyor which carries the completed package to a subsequent station and into engagement with a cutting blade B.

The difficulty heretofore encountered with arrangements constructed according to certain prior art practices is avoided due to the fact that wrapping cage assemblies 2 and 2a upon completion of a packaging operation are moved outwardly in opposite directions from each other simultaneously. Thus any frictional relationship between the platens such as 21, 22, and 26 and the package group P1–P6 or the film F is completely offset so that there is no tendency to disrupt the package or to disarrange the individual items within the package.

INDUSTRIAL APPLICABILITY

A method and apparatus which practices this invention is well suited to situations where economy is important because of the thinness of the stretch material used and because of the substantial reduction in labor cost over known procedures. The mechanism and procedure according to this invention are particularly advantageous when compared with shrink film because of the fact that shrink film requires a film which is considerably thicker and thus more costly than the stretchable film employed according to this invention. Furthermore, shrink film requires a substantial expenditure of energy which is completely avoided by this invention.

We claim:

1. A method of enveloping a plurality of items in a stretchable film comprising the steps of providing a pair of laterally spaced and opposed wrapping cage assemblies each having a plurality of platens projecting inwardly toward the other assembly with the platens of each assembly defining therebetween part of a space for receiving a composite group of items, feeding a web of stretchable film between said cage assemblies so that said web is outside said platen defined spaces, moving said pair of cage assemblies inwardly toward each other to position one of said platens of each assembly behind the web to form a complete qroup receiving space and so that said web is located in said complete space, moving a composite group of items into said complete space defined by said platens so as to capture said web of stretchable film between a surface of the group and said one platen of each of said wrapping cage assemblies, rotating said cage assemblies and the group of items about a common axis so as to envelope the group of items and said platens with stretchable film, and withdrawing said wrapping cage assemblies outwardly away from each other to positions of disengagement with the group and said stretchable film.

2. A method according to claim 1 wherein said cage assemblies are withdrawn substantially simultaneously from the group of items and film.

3. A method according to claim 1 wherein a gripping force is imparted to parts of the group of items which is in a direction generally transverse to the direction of bodily movement of said wrapping cage assemblies.

4. A method according to claim 1 wherein opposed gripping forces are applied to parts of the group of items which are generally in a direction which is substantially aligned with the direction of bodily movement of said wrapping cage assemblies.

5. A method according to claim 4 wherein said opposed gripping forces are maintained until after the wrapping cage assemblies are moved out of engagement with the group following completion of a group enveloping operation.

6. A method according to claim 5 wherein the enveloped group is lowered out of its position of cooperation with said wrapping cage assemblies following completion of a group enveloping operation.

7. A method according to claim 6 wherein said stretchable film web is maintained in a condition of attachment to the group of items for a predetermined time an then severed following completion of a group enveloping operation.

8. A method according to claim 7 wherein said film is maintained in a condition of attachment to the group of items until after a subsequent group is positioned between said wrapping cage assemblies.

9. Apparatus for enveloping a composite group of items in a stretchable film comprising a pair of laterally spaced and opposed wrapping cage assemblies arranged for movement inwardly toward and outwardly away from each other, each assembly having a plurality of platens projecting inwardly toward the other assembly with the platens of each assembly defining therebetween part of a space for receiving a composite group of items, means for feeding a web of stretchable film between said cage assemblies so that said web is outside said platen defined spaces, means for moving said wrapping cage assemblies inwardly to position one of said platens of each assembly behind the web to form a complete group receiving space and so that said web is located in said complete space, means for pushing a composite group of items into said complete space defined by said platens to capture a part of said stretchable film between the composite group and said one platen of each of said wrapping cage assemblies, and means for rotating said wrapping cage assemblies so as to cause said stretchable film to envelope the composite group of items and said platens, said means for moving said wrapping cage assemblies inwardly also having means to move said assemblies outwardly to disengage said platens from said stretchable film and said composite group of items following envelopment of said composite group of items by said film.

10. Apparatus according to claim 9 wherein correlating means forms a part of said means for moving said wrapping cage assemblies outwardly so as to insure substantially simultaneous outward movement of said wrapping cage assemblies.

11. Apparatus according to claim 9 wherein each of said wrapping cage assemblies comprises support structure for said plurality of inwardly projecting platens.

12. Apparatus according to claim 11 wherein only one platen of each wrapping cage assembly is pivotally mounted on its associated support structure.

13. Apparatus according to claim 12 wherein biasing means urges each of said one pivoting platens toward swinging movement about its pivotal mounting in a direction away from the composite group of items.

14. Apparatus according to claim 12 wherein a cam roller is mounted on each of said one pivoting platens and wherein a fixed cam is disposed for engagement by each of said cam rollers, said fixed cams being configured to move each of said one pivoting platens into its wrapping cage forming position in coordination with rotation of said wrapping cage assemblies.

15. Apparatus according to claim 14 wherein biasing means is arranged to urge each of said one pivoting platens about its pivotal mounting in a direction away from the composite group of items and wherein each of said fixed cams is configured to accommodate swinging movement of the associated pivotally mounted platen under the action of its biasing means.

16. Apparatus according to claim 15 wherein each of said pivotally mounted platens is held against swinging movement by the stretchable film during a film wrapping operation.

17. Apparatus according to claim 9 wherein a pair of pressure plates are disposed on opposite sides of the composite group of items and arranged to impart a gripping force thereto.

18. Apparatus according to claim 17 wherein a fixed cylinder and a rotatable piston are associated with each of said pressure plates.

19. Apparatus according to claim 17 wherein the gripping force imparted to the composite group of items is in a direction which is generally parallel with the direction of inward movement of said wrapping cage assemblies.

20. Apparatus according to claim 19 wherein the gripping force imparted to said composite group of articles is maintained until after withdrawal outwardly of said wrapping cage assemblies.

21. Apparatus according to claim 20 wherein a vertically movable support table receives the composite group of items after disengagement thereof by said pressure plates and lowers the composite group out of its wrapping cage position to accommodate entry of a succeeding composite group into a wrapping cage position.

22. Apparatus according to claim 21 wherein said stretchable film web is captured between said one platen of said wrapping cage assemblies and said succeeding composite group while said stretchable film is attached to the preceding composite package group.

23. Apparatus according to claim 22 wherein cutting means is arranged to engage and to sever said stretchable strip at a point thereon which is intermediate said composite groups of items.

* * * * *